United States Patent [19]

Okamura et al.

[11] Patent Number: 4,745,414

[45] Date of Patent: May 17, 1988

[54] RECOVERY DEVICE FOR AN INK JET RECORDER AND A RECOVERY METHOD THEREOF

[75] Inventors: Shigeru Okamura, Kawasaki; Shigeyasu Nagoshi, Tokyo; Toshiyuki Ohnishi, Yokohama, all of Japan

[73] Assignee: Canon Kabushiki Kaisha, Tokyo, Japan

[21] Appl. No.: 34,930

[22] Filed: Apr. 6, 1987

[30] Foreign Application Priority Data

| | | | |
|---|---|---|---|
| Apr. 9, 1986 | [JP] | Japan | 61-81637 |
| Apr. 9, 1986 | [JP] | Japan | 61-81638 |
| Apr. 9, 1986 | [JP] | Japan | 61-81639 |

[51] Int. Cl.[4] ..... G01D 15/16

[52] U.S. Cl. ..... 346/140 R; 346/1.1

[58] Field of Search ..... 346/140, 1.1

[56] References Cited

U.S. PATENT DOCUMENTS

| | | | |
|---|---|---|---|
| 4,306,245 | 12/1981 | Kasugayama et al. | 346/140 R |
| 4,403,233 | 9/1983 | Terasawa et al. | 346/140 R |
| 4,410,900 | 10/1983 | Terasawa | 346/140 R |
| 4,506,277 | 3/1985 | Terasawa | 346/140 R |
| 4,543,591 | 9/1985 | Terasawa | 346/140 R |
| 4,551,735 | 11/1985 | Suzuki et al. | 346/140 R |
| 4,556,894 | 12/1985 | Terasawa | 346/140 R |
| 4,631,554 | 12/1986 | Terasawa | 346/140 R |
| 4,682,184 | 7/1987 | Terasawa | 346/140 R |

*Primary Examiner*—Joseph W. Hartary

*Attorney, Agent, or Firm*—Fitzpatrick, Cella, Harper & Scinto

[57] ABSTRACT

An ink jet recorder is provided with a recovery device for preventing unsatisfactory ink discharge of a recording head, the recovery device being provided with ink suction means having a cap covering an ink discharge port, a vent valve for opening and closing the interior of the cap with respect to the atmosphere and a suction pump for producing a negative pressure in the cap, and wiping means having a cleaning blade adapted to be advanced and retracted relative to the ink discharge port. The cleaning blade is protruded when a motor effecting the sequence operation of the ink suction means revolves in one direction, and is stopped at its retracted position when the motor revolves in the opposite drection. A method of operating such ink jet recorder is characterized by operating the recovery device in one cycle sequence comprising the steps of bringing the cap into intimate contact with the ink discharge port, closing the vent valve, operating the suction pump, opening the vent valve, restoring the suction pump to its initial state, operating the suction pump, restoring the suction pump to its initial state, closing the vent valve, spacing the cap apart from the surface of the ink discharge port, opening the vent valve, and restoring the suction pump to its initial state.

8 Claims, 7 Drawing Sheets

RECOVERY DEVICE FOR AN INK JET RECORDER AND A RECOVERY METHOD THEREOF

BACKGROUND OF THE INVENTION

1. Field of the Invention

This invention relates to a recovery device for preventing unsatisfactory ink discharge caused by clogging of the ink discharge port of a recording head in an ink jet recorder or drying of ink in the ink discharge port and to an operating method for recovery.

2. Related Background Art

An ink jet recorder is constructed such that ink is supplied into a recording head, driving elements (electro-thermal converting members such as heat generating elements or electro-mechanical converting members such as piezo elements) corresponding to a plurality of ink discharge ports formed in the front face of the recording head are driven on the basis of a data signal, and flying ink droplets going from the ink discharge ports toward a sheet (a recording medium such as paper or a thin plastic sheet) are formed and caused to adhere to the sheet, thereby accomplishing recording.

As ink jet recorder of this type, has been provided with a recovery device for effecting the capping of the ink discharge ports and the ink suction from the ink discharge ports for the purpose of preventing the viscosity of ink from being increased by evaporation of ink solvent or the ink discharge ports from being clogged by the drying of ink or the adherence of dust to the ink discharge ports or the mixing of bubbles with the ink.

Heretofore, in the recovery device of this type, design was such that when an undesirable condition such as unsatisfactory ink discharge occurs to the recording head, the user operates the device by a manual manipulation such as a lever operation to thereby recover the recording head from the undesirable condition.

However, in such a prior-art recovery device, there has been required an operation instruction label or the like for enabling the user to perform the recovery operation, and this has led to a problem that the user feels that operation of the recorder is cumbersome.

Also, if the user does not operate the device in accordance with predetermined instructions, it has given rise to a problem that the ink for recording is wastefully sucked and discharged.

Further, in an ink jet recorder of this type, there is also known one which is provided with a recovery device for carrying out the capping of the ink discharge ports, the ink suction from the ink discharge ports or the cleaning (wiping) of the surfaces of the ink discharge ports. The recovering function of such a recovery device may be divided broadly into the function of cleaning the surfaces of the ink discharge ports and the ink sucking function of removing the bubbles in the ink discharge ports or the ink increased in viscosity.

In such a prior-art ink jet recorder, the cleaning means for carrying out the cleaning function and the ink suction means for carrying out the ink sucking function have been of discrete independent constructions and therefore have required discrete drive sources (stepping motors or the like) and drive systems, which in turn has led to a problem that the number of parts is increased and the space required for the apparatus becomes large and the cost and size of the recorder tend to be increased.

SUMMARY OF THE INVENTION

It is an object of the present invention to solve the above-noted problems peculiar to the prior art and to provide a recovery device for an ink jet recorder which is suitable for realizing an automatic recovery operation for carrying out a series of recovering operations simply by the user inputting a signal by means of a switch key.

It is a further object of the present invention to solve the above-noted problems peculiar to the prior art and to provide an ink jet recorder in which the movement of an ink suction system is utilized to drive cleaning means and the cleaning means is set by movement of a carriage, whereby the number of parts of the recovery device can be reduced and reductions in space and cost can be achieved.

Specifically, the recovery device according to the present invention is provided with a cap covering an ink discharge port, a rotatable cam for opening and closing a vent valve communicating the interior of the cap with the atmosphere and advancing and retracting the cap relative to the surface of the ink discharge port, a suction pump for producing a negative pressure in the cap, and a worm wheel having a radial cam portion for driving the suction pump, the worm wheel being disposed coaxially with the rotatable cam and mounted for axial sliding movement relative to the rotatable cam.

Further, the recovery device according to the present invention is provided with ink suction means having a cap covering an ink discharge port, a vent valve for opening and closing the interior of the cap with respect to the atmosphere and a suction pump for producing a negative pressure in the cap, and wiping means having a cleaning blade adapted to be advanced and retracted relative to the ink discharge port, the cleaning blade being protruded when a motor effecting the sequence operation of the ink suction means revolves in one direction, the cleaning blade being stopped at its retracted position when the motor revolves in the opposite direction.

Furthermore, in the operating method according to the present invention, a recovery device having a cap which is in intimate contact with an ink discharge port, vent valve for opening and closing the interior of the cap with respect to the atmosphere and a suction pump for producing a negative pressure in the cap is operated in one cycle sequence comprising the following steps:

A: bringing the cap into intimate contact with the ink discharge port;

B: closing the vent valve;

C: operating the suction pump;

D: opening the vent valve;

E: restoring the suction pump to its initial state;

F: operating the suction pump;

G: restoring the suction pump to its initial state;

H: closing the vent valve;

I: spacing the cap apart from the surface of the ink discharge port;

J: opening the vent valve; and

K: restoring the suction pump to its initial state.

DESCRIPTION OF THE PREFERRED EMBODIMENT

The present invention will hereinafter be specifically described with reference to the drawings.

Figure 1:
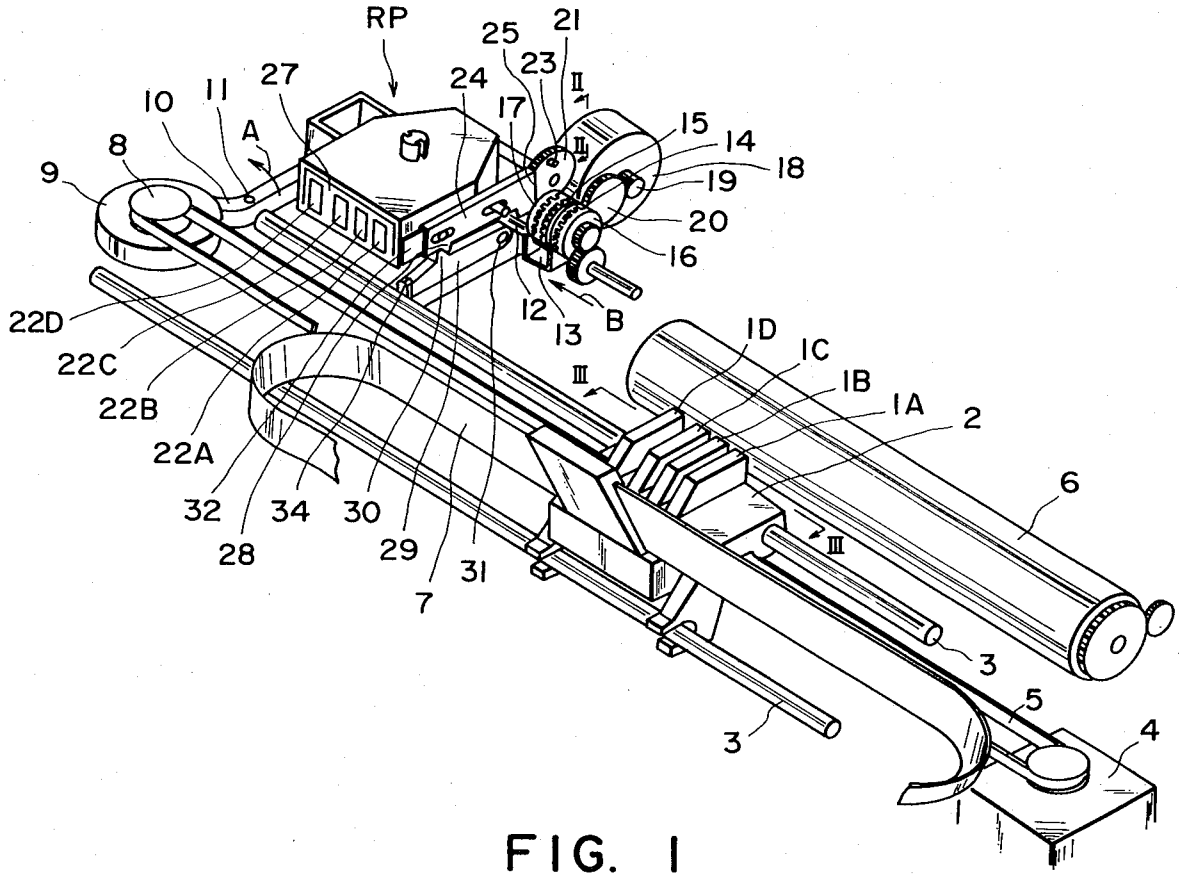
FIG. 1 is a perspective view showing the construction of the essential portions of an ink jet recorder according to an embodiment of the present invention.

FIG. 1 shows the construction of the essential portions of an ink jet recorder according to an embodiment of the present invention.

In FIG. 1, a carriage 2 mounting thereon a plurality of (in the shown example, four) recording heads 1A, 1B, 1C and 1D is guided and supported by guide shafts 3 and 3.

The drive force of a carriage motor 4 is transmitted to the carriage 2 through a timing belt 5, whereby the carriage 2 slides on the guide shafts 3 and 3 and along a platen 6. The carriage 2 is scanned reciprocally by forward and reverse revolutions of the motor 4. A predetermined gap (e.g., of the order of 0.8 mm) is provided between the front faces of the recording heads 1A–1D (the recording surfaces formed with ink discharge ports) on the carriage 2 and the platen 6 (more particularly, a sheet supported on the platen).

During the scanning movement of the carriage 2, a recording signal is output to the recording heads 1A–1D through flexible wiring 7, and the recording heads 1A–1D are driven at a timing associated with the position of the carriage 2 to discharge ink and effect recording on a sheet (a recording medium such as paper or a thin plastic sheet) on the platen 6.

During recording, dust or paper scraps may adhere to the neighborhood of the ink discharge ports (dot forming means comprising, for example, twenty-four orifices) of the recording heads 1A–1D or air may be introduced through the ink discharge ports, thereby causing unsatisfactory ink discharge.

Generally, in an ink jet recorder, a recovery device RP is installed to recover from such unsatisfactory ink discharge.

When a recovery key (not shown) is depressed to recover from the unsatisfactory ink discharge, the recording operation is interrupted and the carriage 2 is moved toward the recovery device RP.

With this movement of the carriage 2 toward the recovery device RP, an idle pulley 8 supporting the rotation of the timing belt 5 at one end thereof is rotated. With the rotation of the idle pulley 8, a planetgear group 9 for speed reduction provided coaxially therewith is also rotated.

When the carriage 2 is moved to a predetermined position toward the recovery device RP, a lever 10 engaged with a cam slot in the final stage gear (not shown) of the planet gear group 9 is pivoted about a shaft 11 in the direction of arrow A by an amount determined by the cam slot.

When the lever 10 is pivoted in the direction of arrow A, a stay 12 engaged with the tip end of the lever 10 slides in the direction of arrow B and a plate 13 fixed to the stay 12 also moves in the direction of arrow B.

This plate 13 is engaged with the circumferential groove 15 of a ratchet gear 14 which is free to rotate and axially movable with the plate 13.

Accordingly, when the plate 13 moves in the direction of arrow B, the ratchet gear 14 is changed over from its meshing engagement with a ratchet gear 16 to its meshing engagement with a ratchet gear 17.

By this change-over, the revolution of a sheet feed motor (hereinafter referred to as the LF moter) 18 becomes transmitted to the ratchet gear 17 through an LF motor gear 19, an idle gear 20 and the ratchet gear 14.

The ratchet gear 17 has a gear portion formed integrally therewith, and this gear portion is in meshing engagement with a gear 21 with a dowel. The gear 21 with a dowel is the input gear of the recovery device RP and therefore, by the aforementioned change-over to the direction of arrow B, the recovery device RP becomes driven by the LF motor 18.

The position of the carriage 2 is controlled with the home position detected by a home position sensor (not shown) installed at the left end portion as a reference.

When the recovery key is operated as previously described, the carriage 2 is moved to a position in which the recording heads 1A–1D are opposed to corresponding rubber caps 22A, 22B, 22C and 22D, respectively. In this position, the LF motor 18 is changed over to the recovery device RP driving side and accordingly, the recovery operation is effected.

Description will now be made of the wiping means for cleaning the recording surfaces of the recording heads 1A–1D (the surfaces formed with ink discharge ports). This wiping means is designed to wipe the ink discharge ports by a cleaning blade 24.

When the LF (line feed) motor 18 revolves, the gear 21 with a dowel is rotated and the dowel 23 thereof comes into engagement with the rear end portion 25 of the cleaning blade 24, which is thus protruded toward the carriage 2 against the force of a return spring (not shown) which biases the cleaning blade toward the LF motor 18.

Figure 2:
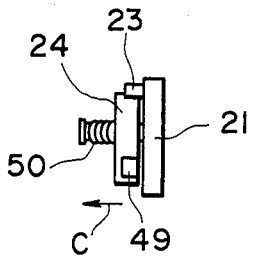
FIG. 2 is a rear view taken along line II—II of FIG. 1.

FIG. 2 shows the portion of engagement between the gear 21 with a dowel and the cleaning blade 24.

The LF motor 18 is stopped when the gear 21 with a dowel has been rotated from the initial position of FIG. 1 to a position in which the dowel 23 presses and displaces the rear end portion 25 of the cleaning blade 24.

Figure 3:
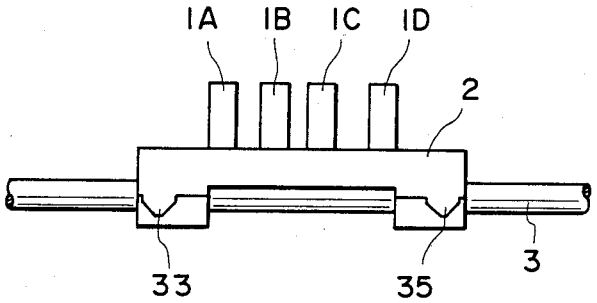
FIG. 3 is a front view of a carriage taken along line III—III of FIG. 1.
Figure 4:
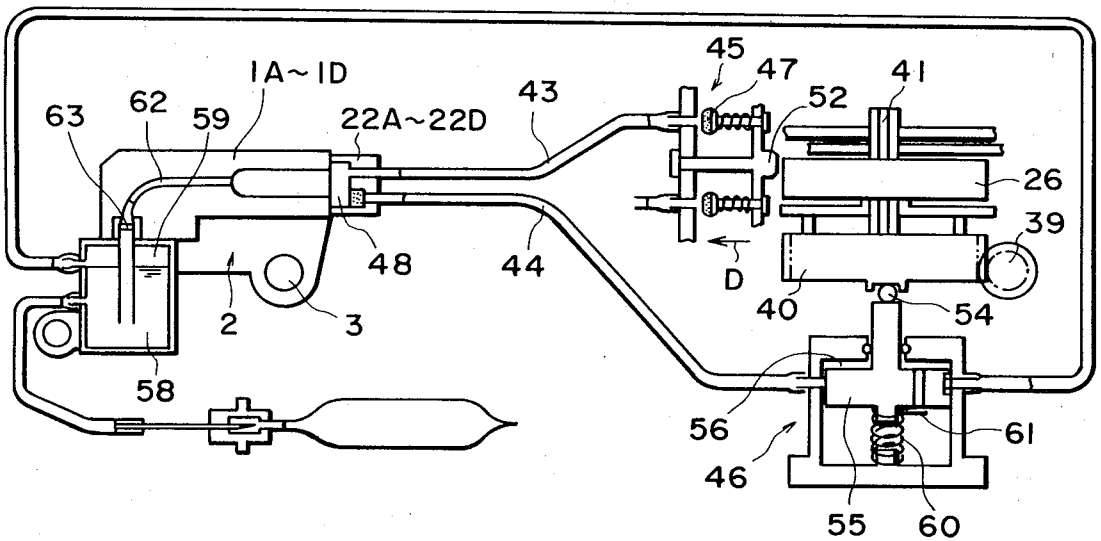
FIG. 4 schematically shows the structure of a recovery device in FIG. 1.

FIG. 3 shows a front view of the carriage 2 taken along line III—III of FIG. 1, and FIG. 4 schematically shows the construction of the entire recovery device RP.

By the revolution of the LF motor 18, the rotatable cam 26 (FIG. 4) of the recovery device RP adapted to be rotated at a final deceleration is also rotated simultaneously.

Therefore, a cap housing 27 supporting the rubber caps 22A–22D tends to move toward the recording heads 1A–1D, but since the reduction ratio of gear 21 with a dowel and the reduction ratio of the rotatable cam (cam disc) 26 from the LF motor 18 greatly differ from each other, the movement of the cap housing 27 can be neglected and the gap between the caps 22A–22D and the recording heads 1A–1D scarcely varies and they do not contact each other.

When the cleaning blade 24 constituting the wiping means is protruded by the rotation of the gear 21 with a dowel, the pawl 28 of the cleaning blade depresses the pawl 30 of a holding lever 29 pivotally mounted on the underside thereof and operates so as to slide over the latter.

Accordingly, the holding lever 29 is rotated counter-clockwise about a lever shaft 31 against the force of a return spring (not shown), and the pawl 28 of the cleaning blade 24 is caught by the pawl 30 of the holding lever 29, whereby the cleaning blade 24 is held in its protruded position.

With the cleaning blade 24 in its protruded position, the carriage 2 is moved toward the platen 6 (rightwardly as viewed in FIG. 1), and wiping of the ink discharge ports of the recording heads 1A–1D is effected by a blade 32 attached to the tip end of the cleaning blade 24.

When the carriage 2 is thus moved from left to right, the reset pawl 33 (FIG. 3) of the carriage 2 comes into engagement with the end pawl 34 of the holding lever 29, which is thus depressed counter-clockwise as viewed in FIG. 1, whereby the engagement between the pawl 28 of the cleaning blade 24 and the pawl 30 of the holding lever 29 is temporarily released.

Therefore, the cleaning blade 24 tries to retract away from the recording heads 1A–1D by the action of a return spring, but in this case, the cleaning blade 24 is prevented from retracting by the gear 21 with a dowel, so that the cleaning blade 24 remains protruded even if the reset pawl 33 of the carriage 2 passes it.

While the carriage 2 is further moved rightwardly, wiping of the ink discharge ports of the recording heads 1A–1D is effected.

In this case, during the period before the revolutional force of the LF motor 18 is changed over to the platen 6 driving side by the movement of the carriage 2 and during which the pawl 30 of the holding lever 29 is positioned between the pair of reset pawls 33 and 35 (FIG. 3) of the carriage 2, the LF motor 18 is changed over to the reverse revolution opposite to the forward revolution during the recovery operation and is reversed to the initial position, whereby the gear 21 with a dowel is returned to the position of FIG. 1.

In the ink suction sequence to be described, the gear 21 with a dowel effects one or more reverse rotations with the aid of the reverse revolution of the LF motor 18, and in that case, the dowel 23 of the gear 21 passes the escape groove 49 (FIG. 2) in the rear end of the cleaning blade 24 and returns to its original position while gradually raising the cleaning blade 24 in the direction of arrow C (FIG. 2) against the force of a spring 50 (FIG. 2). Therefore, the cleaning blade 24 does not protrude to the ink discharge port side.

When the cleaning of all the ink discharge ports of the recording heads 1A–1D is terminated while the carriage 2 is moved from left to right, the reset pawl 35 (FIG. 3) of the carriage 2 comes into engagement with the end pawl 34 of the holding lever 29 and passes the latter, and the cleaning blade 24 is reset and returned to its initial position (the retracted position of FIG. 1) and thus, wiping of the ink discharge ports is completed.

The wiping operation of the wiping means as described above can be executed a plurality of times by reciprocally moving the carriage 2.

Any dust, paper scraps or viscous ink adhering to the ink discharge ports can be reliably removed by such wiping operation.

Description will now be made of the recovery operation by the ink suction from the ink discharge ports.

When the aforedescribed cleaning or wiping of the ink discharge ports is terminated, the carriage 2 is moved leftwardly to the position in which the recording heads 1A–1D are opposed to the caps 22A–22D, respectively, and is stopped at that position.

After the carriage 2 is thus stopped, the LF motor 18 is forwardly revolved.

Figure 5:
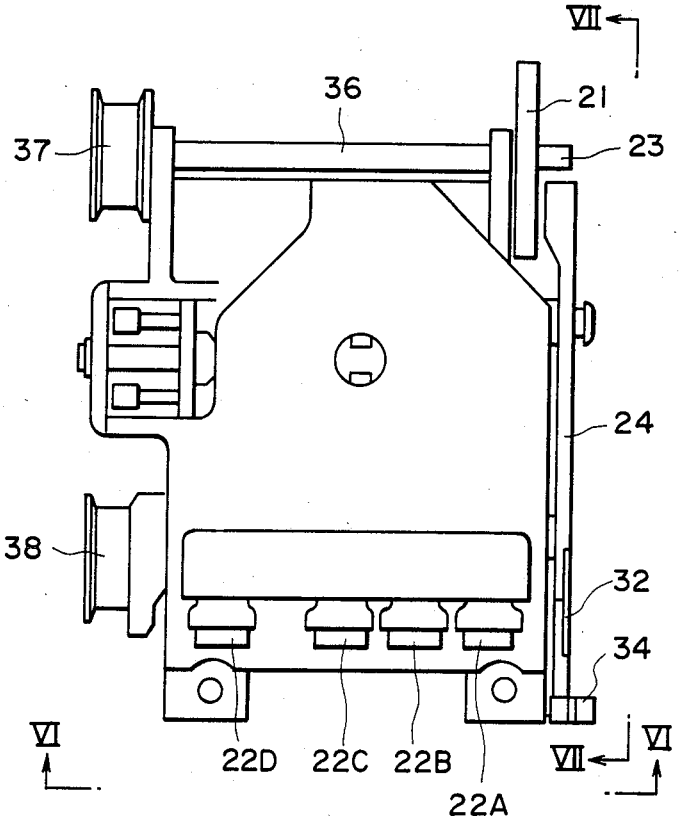
FIG. 5 is a plan view of the recovery device in FIG. 1.
Figure 6:
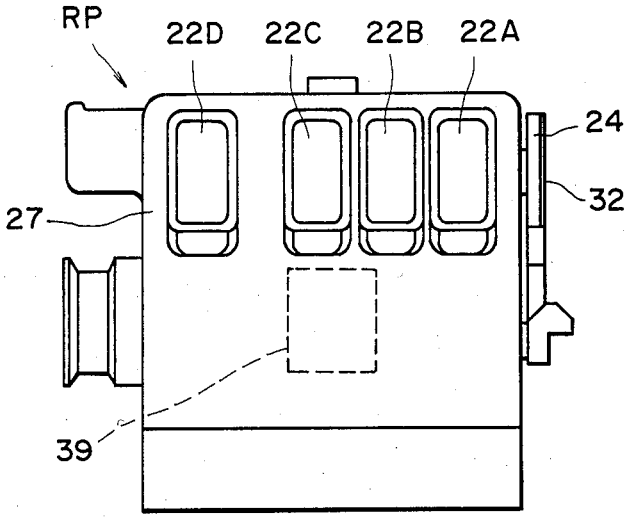
FIG. 6 is a front view taken along line VI—VI of FIG. 5.
Figure 7:
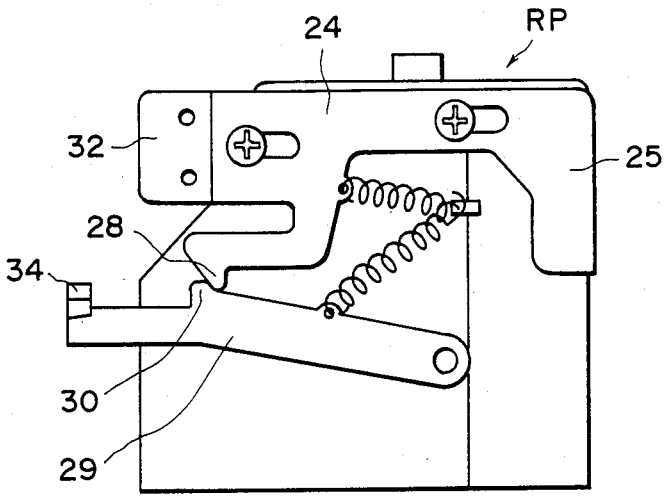
FIG. 7 is a left side view taken along line VII—VII of FIG. 5.
Figure 8:
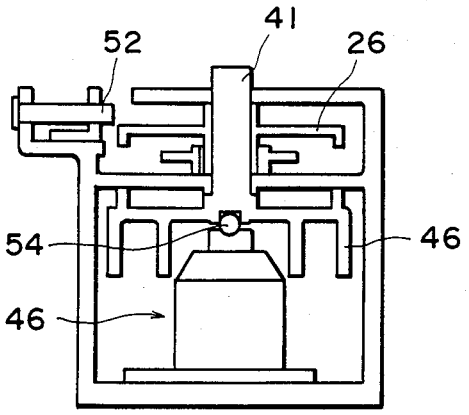
FIG. 8 is a central longitudinal cross-sectional view of the recovery device of FIG. 5.

When this forward revolution continues, the rotational force of the gear 21 with a dowel is transmitted to the shaft 36 thereof (FIG. 5) to rotate a pulley 37 (FIG. 5) rotatable with this shaft and rotate a pulley 38 through a timing belt (not shown), thus rotating a worm 39 (FIG. 4) rotatable coaxially with the pulley 38.

In FIG. 4, the worm 39 is in meshing engagement with a worm wheel 40. A shaft integral with the worm wheel 40 is formed with a plurality of rectangular grooves 41, and with the rotation of the worm wheel 40, the rotatable cam 26 coaxial therewith fits in said rectangular grooves 41 and rotates at the same speed.

Figure 9:
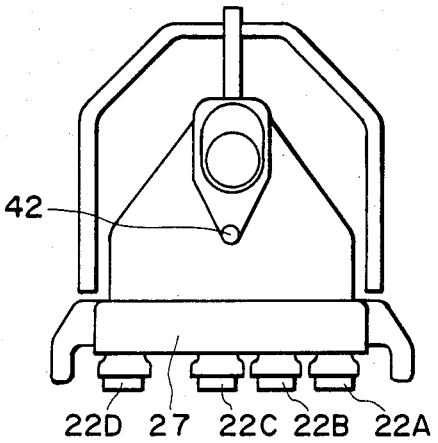
FIGS. 9 and 10 are transverse cross-sectional views at different levels in FIG. 5.

When the revolution of the LF motor 18 continues, the embossment 42 (FIG. 9) of the cap housing 27 engages with the cam slot (not shown) of the rotatable cam 26 and the cap housing 27 is moved toward the recording heads 1A–1D, and the rubber caps 22A–22D come into intimate contact with the surfaces of the ink discharge ports, thus bringing about a capping state (capping closed).

Conduits 43 and 44 are connected to each rubber cap 22A–22D, the conduit 43 is connected to a vent hole 45 and the conduit 44 is connected to a pump 46.

Figure 11:
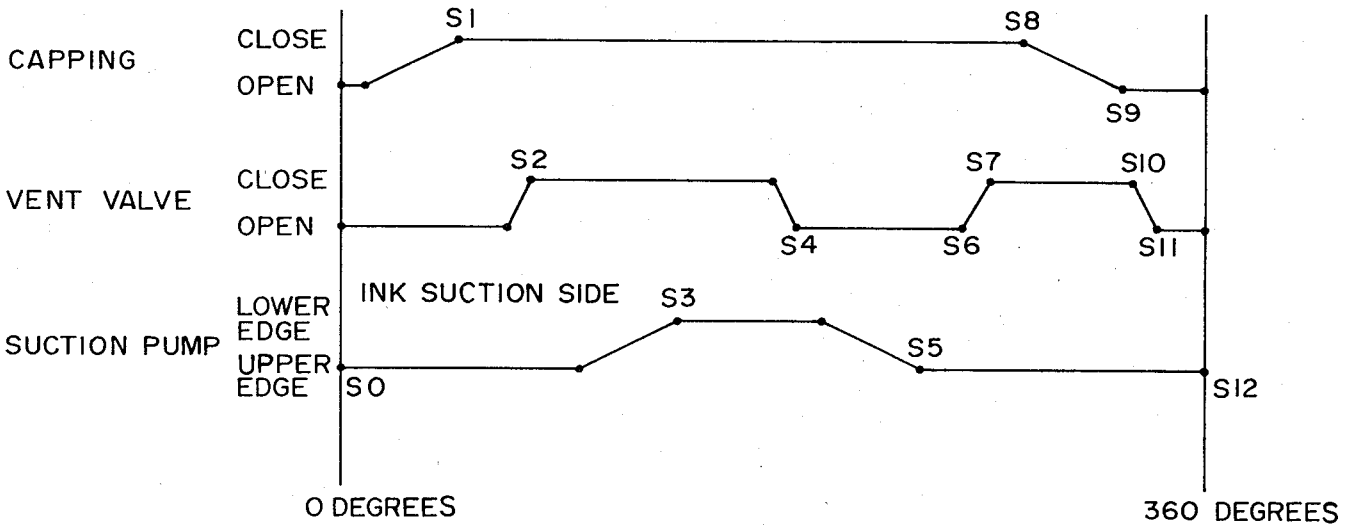
FIG. 11 is a timing chart illustrating the operation sequence of the recovery device of the ink jet recorder according to the present invention.

When the capping state is brought about, a vent valve 47 is in its open state and a vent cam 45 is in its atmospheric state as shown in the suction operation timing chart of FIG. 11, and due to deformation of the rubber caps 22A–22D, retraction of the meniscus of the surfaces of the ink discharge ports of the recording heads 1A–1D will not occur even if the volume of the cap interior 48 is compressed.

When the forward revolution of the LF motor 18 continues, the protrusion 51 on the circumference of the rotatable cam 26 pushes a vent valve support member 52 in the direction of arrow D (FIG. 4) with the rotation of the rotatable cam 26, and the vent hole 45 is hermetically sealed (the vent value closed) by the vent valve 47. This vent valve closed state corresponds to the point S2 in FIG. 11.

When the rotation of the worm wheel 40 (FIG. 4) is continued with the capping closed and the vent valve closed, a plurality of wheel cams (FIG. 4) formed at positions of different diameters in the radial directions of the worm wheel 40 come into engagement with cams of the same diameter on that side of the recovery device RP which is adjacent to the housing whereby the worm wheel 40 is moved downwardly. At this time, the shaft of the worm wheel 40 fits to the rotatable cam (cam disc) 26 and in the rectangular grooves 41 and therefore, the worm wheel 40 is moved downwardly while rotating the rotatable cam 26.

By the movement of the worm wheel 40, the piston 55 of the pump 46 is depressed through the intermediary of a steel ball 54. The steel ball 54 is for preventing the rotation of the worm wheel 40 from being transmitted to the piston 55.

By the piston 55 being so depressed, the interior of the cylinder 56 of the pump assumes a negative pressure and thus, suction of ink is effected from the ink discharge ports through the conduit 44.

The speed of downward movement of the worm wheel 40 can be controlled by the speed of revolution of the LF motor 18, and by the speed of movement of the worm wheel 40 and the amount of inflow of ink by the negative pressure of the interior of the cylinder 56 being taken into account, the suction of ink from the ink discharge ports can be set at a predetermined negative pressure and production of soluble air dissolved in the ink can be prevented.

Figure 10:
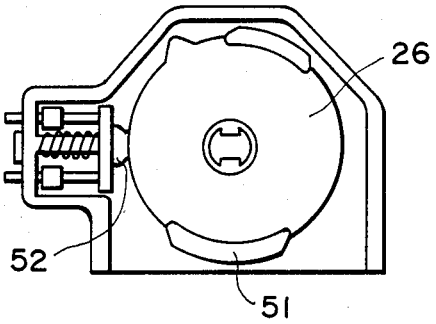

When the worm wheel 40 is moved to the lowermost end (the point S3 in FIG. 11) and continues to rotate in this lowermost end state, the protrusion 51 (FIGS. 10) on the circumference of the rotatable cam (cam disc) 26 passes the vent valve support member 52 (FIG. 4 and 10) and the vent valve 47 (FIG. 4) communicates the vent hole 45 with the atmosphere (the vent valve is open and this corresponds to the point S4 in FIG. 11).

By controlling the speed of rotation of the worm wheel 40 in its lowermost end state, the time until the aforementioned communication of the vent hole 45 with the atmosphere can be controlled.

When the interior of the cylinder 56 is in the negative pressure state and the vent hole 45 communicates with the atmosphere, the sucked ink in the interior 48 of the rubber caps flows into the cylinder 56 through the conduit 44 with the air flowing in from the conduit 43 and thus, the amount of ink remaining in the interior 48 of the rubber caps becomes smaller.

The negative pressure in the cylinder 56 when the vent hole 45 communicates with the atmosphere must be controlled by the speed of rotation of the worm wheel 40 in order that it may be of such a degree that the meniscus of the ink discharge ports does not retract.

The reason is that before the vent hole 45 communicates with the atmosphere, ink is being sucked from the ink discharge ports and the air layer 59 in a sub-tank 58 rearward of the ink discharge ports is under a negative pressure, but when the vent hole 45 communicates with the atmosphere, the ink meniscus of the ink discharge ports is retracted, and to prevent this, it becomes necessary to control the speed of rotation of the worm wheel 40.

When the open state of the vent valve 47 is terminated and the worm wheel 40 continues to rotate, the worm wheel 40 is returned from the lowermost end uppermost end (the initial state) along the formation of the wheel cam by a piston return spring 60 through the piston 55 and steel ball 54. This point in time corresponds to the point S5 in FIG. 11.

Also, when the piston 55 is returned, the ink sucked into the cylinder 56 is discharged through a one-way valve 61 mounted to the piston.

At a point in time whereat the rotated position of the worm wheel 40 is between the points S5 and S6 in FIG. 11, the forward rotation of this worm wheel is changed over to the reverse rotation and the worm wheel is rotated reversely until before the vent valve 47 is opened (the point S4 in FIG. 11) and the air is sucked (idle suction) through the conduit 43, whereby the ink remaining in the interior 48 of the rubber caps during the aforementioned ink suction can be reliably discharged. This idle suction, if repeated frequently, would be more effective.

In the foregoing description, it has been mentioned that when during the forward rotation, the worm wheel 40 is brought from the S3 state (moved to the lowermost end) to the S4 state which is the vent valve open state, it is necessary to control the speed of rotation of the worm wheel 40 so as to provide such a degree of negative pressure that the meniscus of the ink discharge ports does not retract, and the control of this portion can also be carried out by the following method.

If the design is such that the rotation of the wheel 40 is stopped between the S4 state and the S5 state (see FIG. 11) and the next sequence is entered after the air layer 59 in the sub-tank 58 has reliably assumed the atmospheric pressure state, retraction of the meniscus of the ink discharge ports will not occur.

After the aforementioned idle suction has been terminated, the worm wheel 40 further continues its forward rotation from the point between the point S5 and the point S6, and the protrusion 51 on the circumference of the rotatable cam (cam disc) 26 likewise pushes the vent valve support member 52 in the direction of arrow D to thereby close the vent valve 47 (the point S7 in FIG. 11).

At this time, the vent hole 45 is closed by the planar portion of the vent valve 47 and therefore, no variation in the volume of this portion occurs and even in the capping closed state, retraction of the meniscus of the ink discharge ports does not occur.

After the closed state of the vent valve 47 (the point S7 in FIG. 11) has been passed, the state shifts from the rear end of the capping closed (the point S8 in FIG. 11) via the capping open (the point S9 in FIG. 11) and shifts from the rear end of the vent valve 47 closed (the point S10 in FIG. 11) to the vent valve 47 open (the point S11 in FIG. 11), whereafter the state shifts to the terminal end (identical to the initial state), i.e., the point S12 in FIG. 11 (identical to the point S0), thus completing a series of operations.

Unsatisfactory printing can be prevented by the above-described recovery operation being executed, but as a more reliable recovery operation, the following sequence may be added between the point S7 to the point S12.

The operations at the points S7 to S12 to be added will hereinafter be described.

A cause of unsatisfactory printing is the introduction of air from the ink discharge ports or the stagnation of air in the vicinity of the ink discharge ports and in ink passageway to the ink discharge ports, as already described.

Removal of such air can be almost completely accomplished by the ink suction operation from the ink discharge ports, as already described, but there are very rare cases where air in the form of bubbles adheres to the ink supply tube 62 (FIG. 4) to the ink discharge ports of the recording heads 1A–1D or the filter 63 in the ink supply tube 62 and removal of air cannot completely be accomplished by the aforedescribed ink suction sequence, but flying droplets of ink produce splashes or satellites during recording.

To remove these splashes or satellites, the worm wheel 40 is first rotated reversely from the initial point S0 (or the point S12) of the recovery operation sequence to between the vent valve 47 (the point S7) and the rear end (the point S8) of the capping closed, and from that position, the worm wheel 40 is changed over to its forward rotation and returned to the initial point S0 (the point S12).

By repeating this operation a plurality of times, the pressure in the interior 48 of the rubber caps which is in its hermetically sealed state is increased when the rubber caps 22A–22D render the ink discharge ports capped, and thus air is forced in from the ink discharge ports. By the air being thus forced in, the air in the form of bubbles which adhere can be removed.

If the ink suction sequence of the point S0 to the point S12 described above is effected after the above-described operation has been terminated, unsatisfactory ink discharge can be removed more completely.

According to the above-described ink jet recorder in accordance with the present invention, the movement of a part of the operation sequence for sucking ink from the ink discharge ports is utilized to render the cleaning means (the blade) operative and cleaning (wiping) of the ink discharge ports is accomplished by movement of the carriage and further, resetting of the cleaning means can be accomplished by the utilization of the movement of the carriage during another period and therefore, there can be provided a recovery device which does not require any special drive source in cleaning the ink discharge ports and which is simple and highly reliable in structure, and this leads to the provision of an ink jet recorder which is compact and less costly.

According to the above-described method of operating the ink jet recorder in accordance with the present invention, the air in the form of bubbles present in the ink discharge ports which it was difficult to eliminate by the prior art can also be reliably removed to ensure stable, good ink discharge, and this leads to the provision of a method of operating an ink jet recorder which can maintain good quality of printing.

According to the present invention described above, a worm wheel for driving a suction pump which is deceleration-driven is provided coaxially with a rotatable cam which controls capping, and this leads to the compactness and simplification of the structure and the reduced number of parts of the recovery device, as well as the provision of an ink jet recorder which is improved in the reliability of the recovery operation.

We claim:

1. An ink jet recorder provided with a recovery device for preventing unsatisfactory ink discharge of a recording head, said recovery device being provided with ink suction means having a cap covering an ink discharge port, a vent valve for opening and closing the interior of said cap with respect to the atmosphere and a suction pump for producing a negative pressure in said cap, and wiping means having a cleaning blade adapted to be advanced and retracted relative to the ink discharge port, said cleaning blade being protruded when a motor effecting the sequence operation of said ink suction means revolves in one direction, said cleaning blade being stopped at its retracted position when said motor revolves in the opposite direction.

2. An ink jet recorder according to claim 1, wherein a power transmitting portion for protruding said cleaning blade is set at the side more adjacent to said motor than to the driving mechanism of said ink suction means.

3. An ink jet recorder according to claim 1 or 2, wherein a reset pawl for returning said cleaning blade to its initial position is provided on a carriage.

4. An ink jet recorder according to claim 3, wherein said reset pawl is provided at two locations spaced apart from each other by a predetermined distance.

5. A method of operating an ink jet recorder provided with a recovery device for preventing unsatisfactory ink discharge of a recording head, said recovery device having a cap which is in intimate contact with an ink discharge port, a vent valve for opening and closing the interior of said cap with respect to the atmosphere and a suction pump for producing a negative pressure in said cap, said method being characterized by operating said recovery device in one cycle sequence comprising the steps of : A : bringing said cap into intimate contact with the ink discharge port; B : closing said vent valve; C : operating said suction pump; D : opening said vent valve; E : restoring said suction pump to its initial state; F : operating said suction pump; G : restoring said suction pump to its initial state; H : closing said vent valve; I : spacing said cap apart from the surface of the ink discharge port; J : opening said vent valve; and K : restoring said suction pump to its initial state.

6. A method according to claim 5, characterized in that in said sequence, the step F of operating said suction pump is performed by revolving the drive motor of said recovery device in a direction opposite to the forward sequence, and the next step G of restoring said suction pump to its initial state is performed by reversely revolving said drive motor to a predetermined position, and thereafter returning said drive motor in the forward direction.

7. A method according to claim 5, characterized in that in said sequence, the sequence portion of the steps H, I and J is performed by revolving the drive motor of said recovery device in a direction opposite to the forward sequence before the sequence of the steps A-K is entered, and said drive motor is revolved to a position in which said cap is brought into intimate contact with the surface of the ink discharge port, whereafter in that position, said drive motor is changed over to the forward direction, whereby the initial state of the step K is restored.

8. An ink jet recorder provided with a recovery device for preventing unsatisfactory ink discharge of a recording head, said recovery device being provided with a cap covering the surface of an ink discharge port, a rotatable cam for opening and closing a vent valve communicating the interior of said cap with the atmosphere and for advancing and retracting said cap relative to the surface of the ink discharge port, a suction pump for producing a negative pressure in said cap, and a worm wheel having a radial cam portion for driving said suction pump, said worm wheel being disposed coaxially with said rotatable cam and mounted for axial sliding movement relative to said rotatable cam.

* * * * *

UNITED STATES PATENT AND TRADEMARK OFFICE

CERTIFICATE OF CORRECTION

PATENT NO. : 4,745,414

DATED : May 17, 1988

INVENTOR(S) : SHIGERU OKAMURA, ET AL.

It is certified that error appears in the above-identified patent and that said Letters Patent is hereby corrected as shown below:

COLUMN 1

Line 25, "As" should read --An--.
Line 25, "type," should read --type--.

COLUMN 2

Line 45, "vent valve" should read --a vent valve--.

COLUMN 3

Line 63, "planetgear" should read --planet gear--.

COLUMN 4

Line 16, "LF moter)" should read --LF motor)--.

COLUMN 6

Line 37, "vent cam 45" should read --vent hole 45--.
Line 49, "value" should read --valve--.

COLUMN 7

Line 16, "(FIGS. 10)" should read --(FIG. 10)--.
Line 50, "uppermost" should read --to the uppermost--.

UNITED STATES PATENT AND TRADEMARK OFFICE

CERTIFICATE OF CORRECTION

PATENT NO. : 4,745,414

DATED : May 17, 1988

INVENTOR(S) : SHIGERU OKAMURA, ET AL.

It is certified that error appears in the above-identified patent and that said Letters Patent is hereby corrected as shown below:

COLUMN 8

Line 10, "wheel 40" should read --worm wheel 40--.
Line 42, "to" should read --and--.

Signed and Sealed this

Twenty-fourth Day of January, 1989

*Attest:*

DONALD J. QUIGG

*Attesting Officer*

*Commissioner of Patents and Trademarks*